US005232431A

United States Patent [19]

Helseth

[11] Patent Number: 5,232,431

[45] **Date of Patent: * Aug. 3, 1993**

[54] TWIST-TIE MATERIAL AND METHOD OF FABRICATION

[75] Inventor: James R. Helseth, Minnetonka, Minn.

[73] Assignee: Twist-Ease Inc., Minneapolis, Minn.

[ * ] Notice: The portion of the term of this patent subsequent to Mar. 3, 2009 has been disclaimed.

[21] Appl. No.: 746,231

[22] Filed: Aug. 14, 1991

Related U.S. Application Data

[60] Continuation-in-part of Ser. No. 529,899, May 29, 1990, Pat. No. 5,092,830, which is a division of Ser. No. 392,766, Aug. 11, 1989, Pat. No. 4,948,202.

[51] Int. Cl.[5] ..... B31D 1/00; B65D 77/10

[52] U.S. Cl. ..... 493/352; 493/962; 24/30.5 T

[58] Field of Search ..... 493/361, 362, 363, 364, 493/365, 366, 367, 368, 369, 372, 352, 962; 53/138 A; 83/40, 42, 44, 50; 24/30.5 R, 30.5 P, 30.5 T; 156/179

[56] References Cited

U.S. PATENT DOCUMENTS

| | | | |
|---|---|---|---|
| 628,642 | 7/1899 | Wyman . | |
| 740,001 | 9/1903 | Flanagin . | |
| 1,441,359 | 1/1923 | Langston | 493/362 |
| 2,050,394 | 8/1936 | Straubel | 493/363 |
| 2,973,597 | 3/1961 | Powell | 24/30.5 T |
| 2,984,161 | 5/1961 | Cook et al. | 493/365 |
| 3,068,135 | 12/1962 | Bower | 24/30.5 T |
| 3,290,854 | 12/1966 | MacMurray | 24/30.5 T |
| 3,409,948 | 11/1968 | Goodwin | 24/30.5 T |
| 3,774,755 | 11/1973 | Cast et al. . | |
| 4,052,886 | 10/1977 | Buick . | |
| 4,509,231 | 4/1985 | Paxton . | |
| 4,539,237 | 9/1985 | Clayton | 24/30.5 R |
| 4,543,862 | 10/1985 | Levene et al. . | |
| 4,558,813 | 12/1985 | Richards . | |
| 4,596,195 | 6/1986 | Wenger . | |
| 4,621,732 | 11/1986 | Olson | 24/30.5 R |
| 4,948,202 | 8/1990 | Helseth | 24/30.5 T X |
| 5,092,830 | 3/1992 | Helseth | 493/352 |

*Primary Examiner*—William E. Terrell
*Attorney, Agent, or Firm*—Merchant, Gould, Smith, Edell, Welter & Schmidt

[57] ABSTRACT

A dispenser system for dispensing a plurality of twist-ties like closure devices 52 arranged in side-by-side alignment and attached at a second end 61 in sheets 50. The attached second ends 61 are crimped about a rod 51 which is inserted in slots 107 defined in side edges 102 of dispenser 100. A plurality of sheets 50 may selectively be inserted in dispenser 100. The dispenser also includes a cover 103 and a tie alignment block 106. The individual ties have a series of transverse perforations 53, 54 through the wire 55 and proximate the wire 55 to ensure ease of removal and ensure reference of the rotating devices 242 utilized in fabricating the tie 52. Fabrication of the sheets 50 includes taking a stock of uncut twist-tie material 21, advancing it into a cutting station 203 utilizing rotating knives 242, and guillotine-style knives 245, 246. The material 20 is then advanced to a crimping station 205. The material 201 is crimped prior to being cut transversely by knife 253 which transfers the material into sheets 50.

19 Claims, 10 Drawing Sheets

FIG. 4
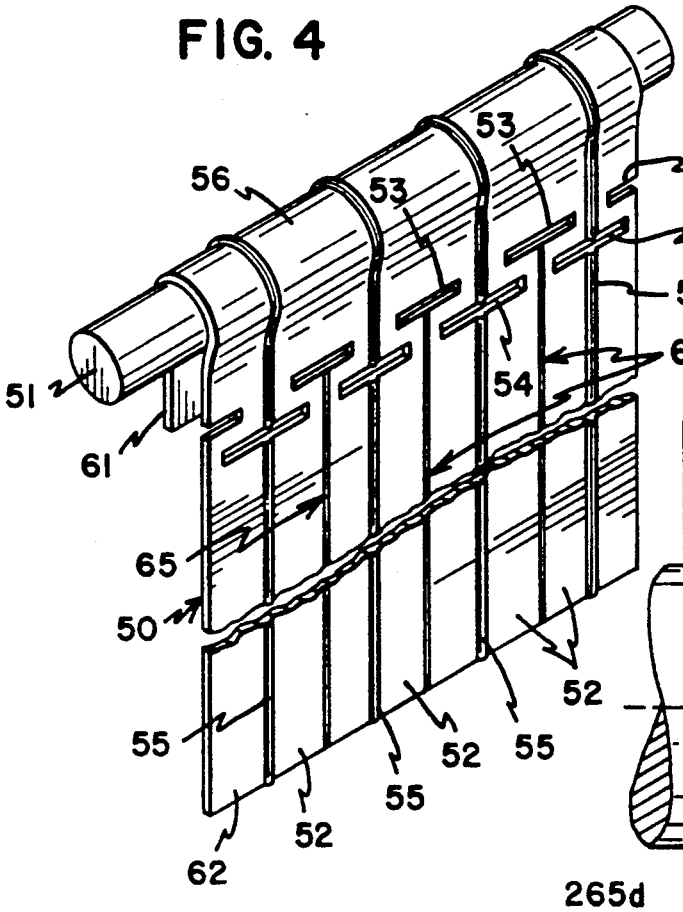
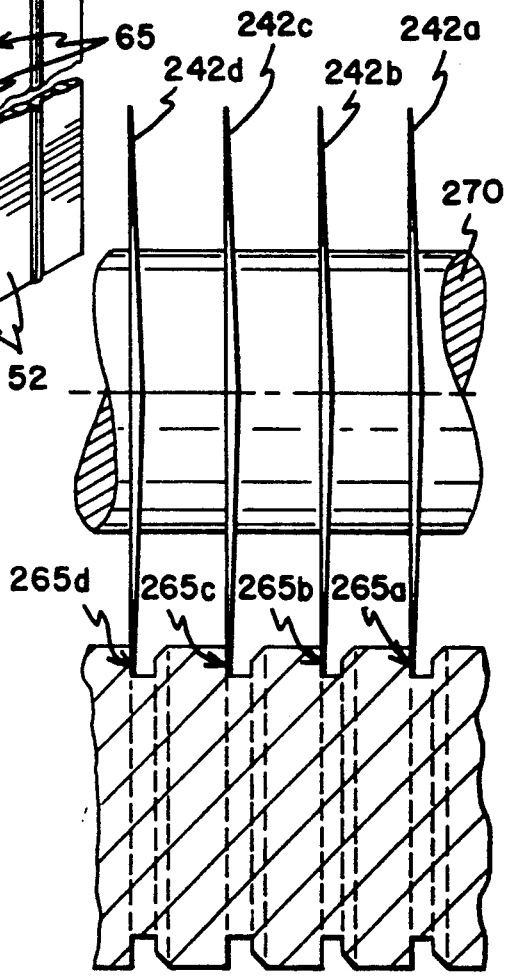
FIG. 6

FIG. 13c
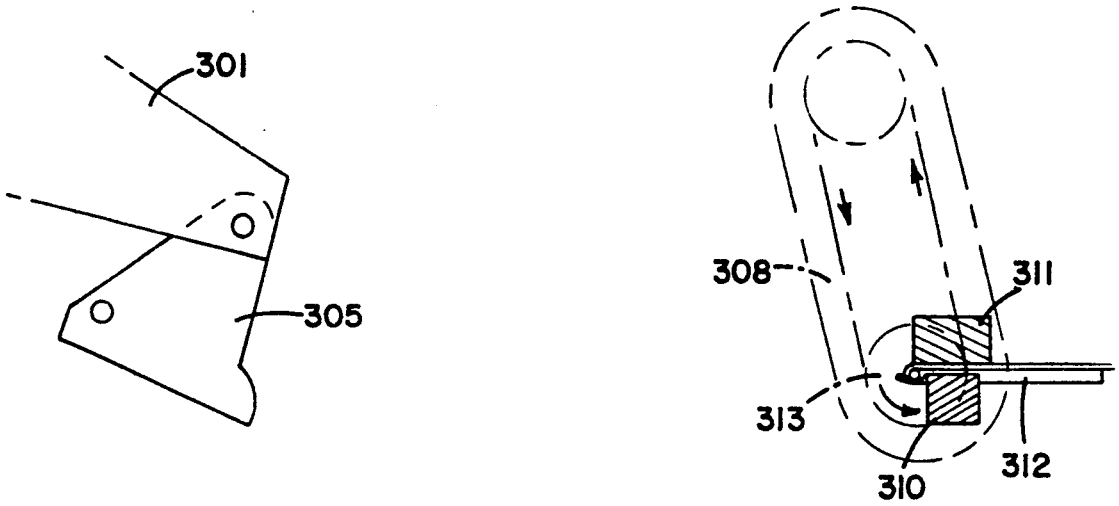
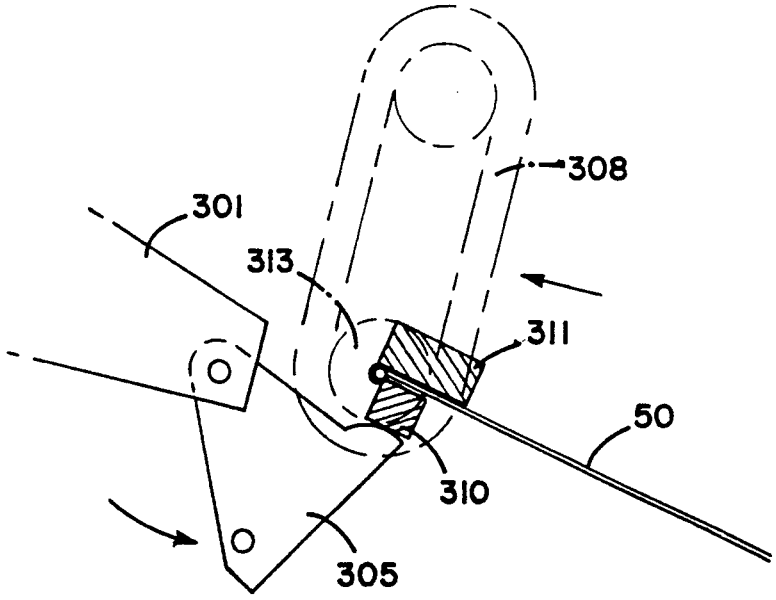
FIG. 13d

TWIST-TIE MATERIAL AND METHOD OF FABRICATION

This application is a continuation-part of U.S. patent application Ser. No. 07/529,899, filed May 29, 1990, now U.S. Pat. No. 5,092,830 which is a divisional of U.S. patent application Ser. No. 07/392,766, filed Aug. 11, 1989 now U.S. Pat. No. 4,948,202.

FIELD OF THE INVENTION

This invention relates generally to a dispenser system and more specifically to a method of fabricating twist-tie material for a dispenser system for twist-tie style closure devices for bags and the like.

BACKGROUND OF THE INVENTION

In grocery stores and other locations where produce and other foodstuffs are placed in bags for containment and carrying, generally a closure device is provided in order to temporarily close or seal the bag such that spillage of the contents does not occur. Typically, the closure device is either a twist-tie or a plastic lock device of the type manufactured by the Kwic-lok Company of Yakima, Wash.

Generally, a twist-tie is comprised of a length of wire embedded in a paper or plastic strip. The wire strength is such that the device may be easily looped about the open end of a bag or other object requiring closure or retention and the wire may then be twisted about itself. The wire is fully annealed with the gauge of wire commonly used being approximately 27 gauge. The paper or plastic wrapping serves the function of protecting the user of the device from sharp wire ends, facilitating ease of unfastening the device by urging the twisted wire into a larger pattern, and providing an aesthetic device.

The twist-tie itself is typically separated into individual component devices, or is arranged and configured in a side-by-side manner with other twist-ties. In the latter configuration, the twist-ties usually include perforations between the individual ties to provide for removal of the ties from one another.

Twist-ties, however, suffer a drawback when used in an environment wherein either a large number of people will be utilizing the supply of ties, for sanitary and entropy reasons, or a large number of ties are required to perform the task at hand. In the grocery market example, sanitary conditions are of utmost importance and so requires consideration in the manner of dispensing the ties. Further, spillage of ties is a concern for safety reasons among others. Heretofore, however, dispensing methods in such stores were limited to bulk dispensing of either individual ties within a container or bulk dispensing of ties in a side-by-side situation. In both cases, each consumer desiring a single twist-tie was forced to come into physical contact with a number of ties in addition to the tie which the consumer chose during the selection process. Additionally, if the side-by-side arrangement was utilized, selection of the twist-tie often required two hands, causing inconvenience to the consumer.

The second type of closure utilized is the "kwic-lock" type device referred to above. The plastic lock device is comprised of an integral "c" shaped portion and a tab portion. The device is installed on a bag by gathering the bag to form a neck (often accomplished in practice by holding the open end of the bag and spinning the lower end of the bag), placing the "c" portion of the lock against the neck, and twisting the tab portion. The twisting motion forces the jaws apart slightly and twists them into a position wherein the neck of the bag slips through the jaws and into the center of the "c". The neck of the bag is then secured.

Conversely, twisting force applied to the tab portion when the device is inserted around the neck of the bag opens the jaws of the "c" portion slightly, while twisting the jaws. This allows the bag to slip through the jaws. The device is then released from the bag.

The drawbacks associated with the dispensing of this plastic lock device in a grocery type environment are similar to those set forth in regard to the twist-ties. The typical dispensing methods of the plastic lock device include bulk dispensing in a container or inserting the plastic lock device jaws onto a steel rod such that a number of devices are in a face-to-face arrangement with one another. Sanitary considerations are again a concern, since in both cases, the consumer is likely to contact a great number of devices in selecting the device for the consumer's personal use. Further, the relative ease of securing the device, the cost of the devices and the diversity of uses of twist-ties over kwic-lock style devices generates a demand for the twist-ties.

Therefore, there arises a need for a twist-tie dispenser system which enables consumers to select individual twist-tie style closure devices without handling additional twist-ties, other than the one chosen during the selection process. Further, there arises a need for a process to fabricate the twist-ties for such a dispenser.

SUMMARY OF THE INVENTION

The present invention provides a simple, relatively inexpensive, and yet reliable method and apparatus for fabricating and dispensing a plurality of selectively removable twist-tie style closure devices in a hygienic, organized, spill resistant fashion.

In the preferred embodiment fabrication process, twist-tie material in bulk web form (i.e., in large uncut rolls wherein the wires are embedded generally parallel to the rolls longitudinal length) is advanced to a cutting station, and then to a crimping section. In the cutting station the material proceeds from a first cutting area which cuts the material longitudinally between the wires from a first end a predetermined distance. Thus, a predetermined longitudinal length at a second end is left uncut. The material advances to a second cutting area wherein the wires are cut transversely and .a second optional cut is made transversely between the wires (preferably the transverse cuts are proximate the demarcation of the cut and uncut longitudinal length). A third cutting area is also provided wherein the material is cut into sheets by a complete transverse cut across the material thereby forming the first end of the sheet while simultaneously forming the second end of the next sheet. In the first cutting area the material is advanced between a set of counter-rotating tensioning rollers, around a guide roller and through a set of rotating knives. The material then passes through a second set of counter-rotating tensioning rollers. The second cutting area comprises two guillotine-style cutting knives offset from one another. The third cutting area comprises a guillotine-style cutting knife. Prior to the operation of the third cutting station, the sheet of material advances into the crimping station which is comprised of a hinged plate which folds at the hinge. The material located between the surfaces of the hinged plate which are brought together, thereby crimping the uncut area of the material at the second end about a rod.

In an alternative embodiment, the material is advanced beneath a cutting die which cuts the twist-tie material between the wires and at a first end. The die also perforates the material transversely at a predetermined distance from the first end, preferably including a series of first perforations across the wires and a series of second perforations on either side of the wires, the second perforations being located proximate the first perforation. The web material is then advanced incrementally beneath the cutting die. The die then cuts a second sheet. This second cut/perforation step forms the first end of the second sheet of twist-ties, while, inherently, at the same time forming the second end of the first sheet. The process of advancing and cutting-/perforation is continued, forming additional sheets of twist-tie materials.

Using either method, the individual sheets of twist-tie material are supported by the rod when the rod is supported at its two ends.

The rod supported sheets may then be inserted into a dispenser system having opposing sides and an adjoining back wall. The dispenser utilizes a cover, for hygienic and sanitary reasons, which covers a portion of the sheets. The dispenser further comprises sheet alignment means, wherein the sheets are positioned away from the back wall of the dispenser so as to be easily selected by a user. Those skilled in the art will appreciate upon a more detailed description below and upon reference to the Figures that the cut sheets may be utilized in manners other than in combination with the preferred rod and dispenser. For example, one or more sheets might be affixed to one another at the second uncut ends, with the outermost sheet being affixed to a flat surface by means of an adhesive, or a tape, in order to dispense the ties.

One preferred dispenser embodiment includes: (a) a pre-cut sheet of twist-tie material, said sheet comprising a plurality of twist-ties in side-by-side alignment, said twist-ties having a first end and a second end, said twist-ties having a perforation proximate said second end; (b) a rod, said pre-cut sheet of twist-tie material cooperatively engaging said rod, wherein a force applied to said first end of said twist-ties detaches said twist-ties at said perforation and said second end of said twist-tie remains engaged with said rod; and (c) a frame, said frame cooperatively engaging said rod and arranged and configured wherein said first ends of said twist-ties are exposed.

Additionally, said perforation includes a series of transverse perforations of said twist-ties, and there is provided a first perforation located proximate the transverse center of the twist-tie and a second perforation comprised of two perforations proximate the transverse edges of the twist-tie, said second perforation proximate said first perforation, whereby ripping of the twist-tie paper is facilitated so as to ease removal of the twist-tie from the dispenser system.

Therefore according to one aspect of the invention, there is provided a method for fabricating a sheet of twist-tie material, of the type wherein individual twist-ties may be removed, the method comprising the steps of:

(a) advancing a strip of uncut twist-tie material into a cutting station, said strip having a first end and a second end;

(b) longitudinally cutting said twist-tie material from said first end to a predetermined distance, said longitudinal cut forming two or more longitudinal strips which are integrally connected to one another at said second end, wherein said predetermined distance is less than the final length of the sheet;

(c) perforating said twist-tie material transversely at a predetermined distance from said second end, wherein said longitudinal strips remain integral with said uncut second end.

According to a further aspect of the invention, there is provided a method as recited above further comprising the steps of cutting the material at the first end and advancing said strip of twist-tie material and repeating steps (a) through (c), wherein said perforating step at said first end creates a second end of the advancing twist-tie material.

According to a further aspect of the invention, there is provided a method as recited above, further comprising the step of crimping the second ends of said cut strips of twist-tie material about a rod.

Another aspect of the invention includes (a) a plurality of wires arranged generally parallel to one another, each of said wires including a first and second end; (b) a material into which said wires are embedded, said material extending between said sires; and (c) wherein the material is cut longitudinally between said wires from said first end to proximate said second end and wherein said wire is cut transversely proximate said second end, whereby individual twist-ties are formed which are joined to one another at said second end.

According to another aspect of the invention, there is provided a method of manufacturing a sheet of twist-tie material, comprising the steps of: (a) drawing a web of uncut, ganged twist-tie material, said material having wires running generally parallel to one another and to the longitudinal axis of said material, between a rotating knife, wherein said rotating knife cuts a predetermined length of twist tie material and does not cut a second predetermined length, said longitudinal cut portions located between said wires; (b) perforating the wire generally proximate the area where the longitudinally cut and uncut areas of twist tie material meet, wherein said perforation step leaves enough twist tie material transversely between cuts such that the cut tie remains affixed to the uncut area; and (c) cutting the twist tie material transversely to form an individual sheet.

While the invention will be described with respect to a preferred embodiment configuration and with respect to particular components used therein, it will be understood that the invention is not to be construed as limited in any manner by either such configurations or components described herein. Variations of the invention will become apparent to those skilled in the art upon a more detailed description of the invention.

These and various other advantages and features which characterize the invention are pointed out with particularity in the claims annexed hereto and forming a part hereof. However, for a better understanding of the invention, its advantages and objectives obtained by its use, reference should be had to the Drawing which forms a further part hereof and to the accompanying descriptive matter, in which there is illustrated and described a preferred embodiment of the invention.

DESCRIPTION OF THE DRAWING

Referring to the Drawing, wherein like numerals represent like parts throughout the several views:

FIG. 4 is an enlarged perspective view of a portion of a dispensing sheet 50 of FIG. 1;

FIG. 6 is a plan view of a portion of the cutting disks 242, 243 comprising first cutting area of the cutting station 203;

FIGS. 13*a*-13*d* illustrate diagramatically the operative steps of crimping station 205 of FIG. 5.

DETAILED DESCRIPTION OF THE PREFERRED EMBODIMENTS

As mentioned above, the principles of this invention apply to the fabrication of a plurality of twist-ties and for dispensing the twist-ties in a dispensing system. More specifically, this invention provides for the fabrication and subsequent dispensing of individual selectively removable twist-ties in a setting requiring dispensing of twist-tie closure devices to a plurality of consumers thereby requiring hygienic considerations, and/or the dispensing of a plurality of twist-ties in an environment wherein the orderly removal of individual twist-ties which can be quickly and easily grasped is desired, or required. The individual selectively removable twist-ties will be referred to hereafter as "twist-ties" or merely "ties" for convenience.

A preferred application for this invention is in the dispensing of twist-ties in a grocery produce or other foodstuff type setting. For example, in the dispensing of fresh fruits in a grocery market, consumers often bag produce in a clear plastic bag and then desire a closure device so as to minimize or eliminate spillage of the fruit. Such application is typical of only one of enumerable types of applications in which the principles of the present invention can be employed.

In order to facilitate a clearer understanding of the present invention, a detailed description of the fabrication of the twist-tie sheets 50 (best seen in FIG. 4) will be deferred pending a discussion of the sheet 50 and dispenser 100 system 20.

Dispenser System

Figure 1:
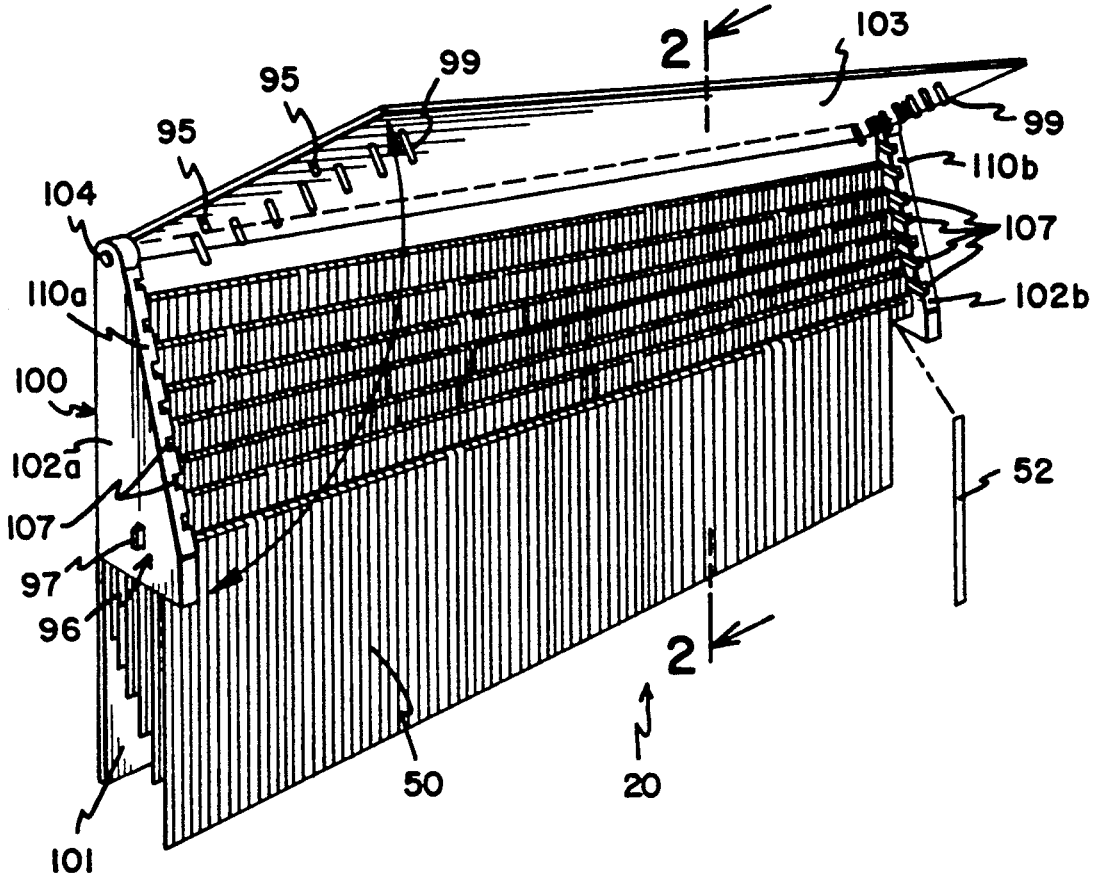
FIG. 1 is a perspective view of a preferred embodiment twist-tie dispenser constructed according to the principles of the present invention.

In a preferred application of the invention, the combination of a plurality of cut twist-tie sheets 50, and dispenser apparatus 100, are shown generally in FIG. 1 at 20.

Dispenser 100 is comprised of back portion 101, adjoining two oppositely disposed side portions 102*a* and 102*b*. In the preferred embodiment, side portions 102 are mirror images of one another.

Dispenser 100 also includes hinged cover 103, utilizing hinges 104. Such hinges may also be of the integral type, for example a "living hinge" made as part of an injection molding process. Cover 103 might also be hinged at the front or rear of the dispenser 100 rather than the center. Dispenser 100 further includes key-hole style holes (not shown) formed through back portion 101 which aid in mounting dispenser 100. Although dispenser 100 is described as having key hole style mounting holes, any other number of suitable mounting means might be utilized, such as two-face tape, screws, etc. as those skilled in the art will recognize.

In the preferred embodiment, cover 103 is an opaque ABS style material or other suitable high impact plastic such as polypropylene, nylon, high impact styrene and the like. Cover 103 may also be clear in order to allow consumers to view the individual ties 52 (best seen in FIG. 4) for selection. Dispenser 100 is preferably fabricated by plastic injection molding or by other well known means.

Side portions 102*a*, 102*b*, as well as back portion 101 are similarly made of ABS plastic and are also preferably opaque. Back portion 101 may be a contrasting color from the twist-tie material sheets 50, for ease in selecting the ties 52, to determine if ties 52 remain in the dispenser 100 and for aesthetic purposes. For cost considerations, and if a single injection molding process is utilized, side 102, back 101 and cover 103 may all be of the same color and material and, may be constructed integral to one another.

Those skilled in the art will recognize that although sides 102, back portion 101 and cover 103 are preferably constructed of plastic, any other suitable type of resilient, high impact material might be utilized, with the design considerations being resistance to cracking, temperature resistance, and manufacturing costs among others.

Side portions 102 extend approximately normally from the plane formed by back portion 101. The edge 110 of side portions 102 taper as side portions 102 extend toward the top of dispenser 100. The tapering edge 110 provides for easier insertion of the twist-tie material sheets 50 and provides that each of the slots 107 (described below) defined within side portions 102 are of approximately equal length. However, the exact shape of side portions 102 and edges 110 are a matter of design choice.

Rear portion 101 extends below the ends of side portions 102 to the approximate length of the lowest hanging sheet 50. Such extension affords protection to sheet material 50 from the surface on which dispenser 100 is mounted, as well as from potential contamination, condensation or misting from the rearward direction. Condensation can occur if the dispenser 100 is located in a produce section where cooler air mixes with warmer ambient store air thereby causing condensation. Misting, on the other hand, is routinely utilized in produce sections in order to keep greens fresh and crisp. It is a process wherein water is actually applied as a fine mist to the produce. The extension may also be a similar color background as the sheets 50 for aesthetic reasons. Alternatively, a contrasting background from the sheet 50 may be provided so that consumers can easily discriminate and select an individual tie 52.

Figure 2:
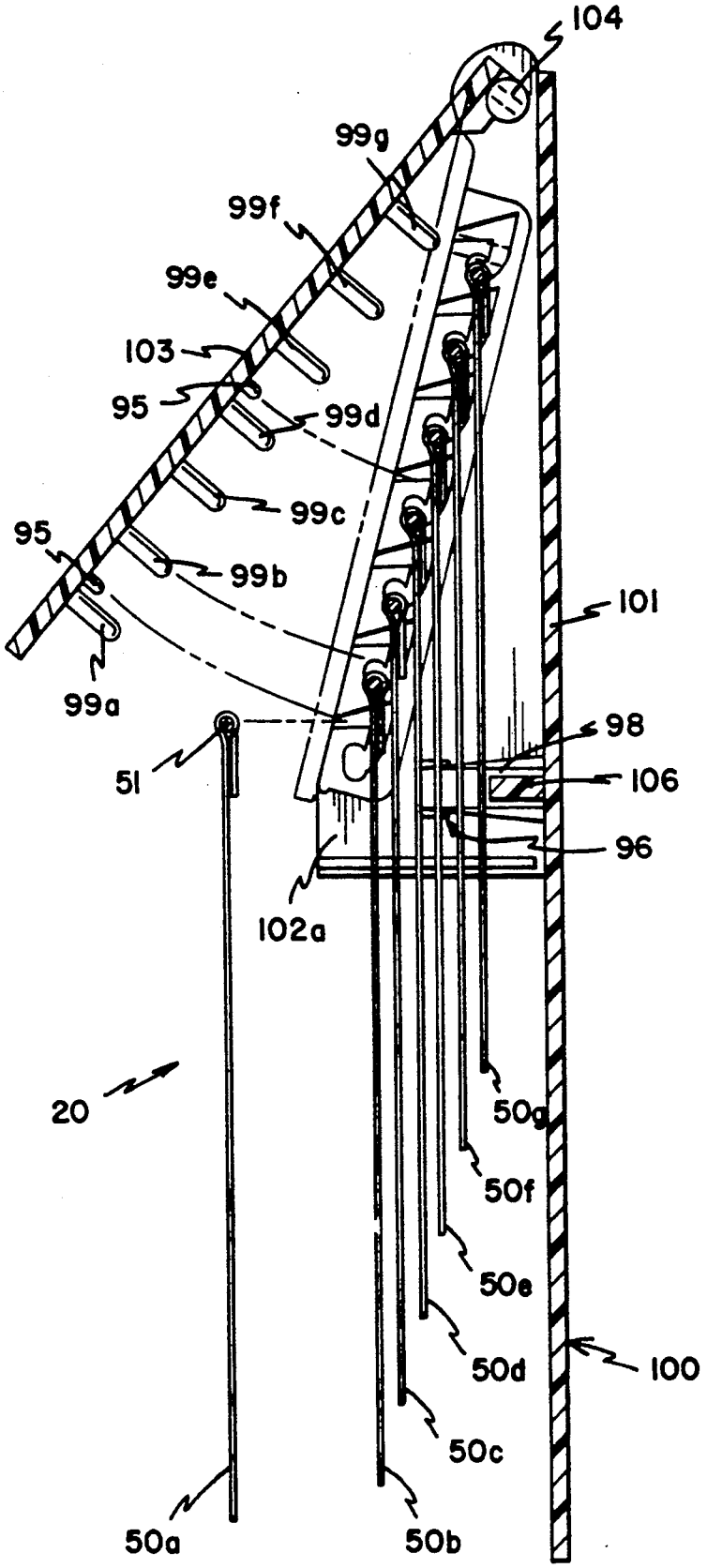
FIG. 2 is a cross-section view of the dispenser taken through line 2—2 of FIG. 1.

As illustrated in FIG. 2, twist-tie sheets 50 hang downward approximately vertically within the dispenser 100, while twist-tie alignment means 106 ensure that the rearward-most sheet 50*g* hangs away from the back portion 101. The positioning of the rearward most sheet 50*g* provides for easier removal of ties 52 from the dispenser 100. Alignment means 106 is preferably an integrally molded portion of back portion 101 and is arranged and configured so as to position sheet 50*g* in an approximately vertical position, while simultaneously being located above the bottom end of sheet 50*g* to avoid hindering removal of twist-ties 52 by individuals.

Also illustrated in FIG. 2 are pins 99 which are integrally formed with cover 103. Pins 99*a*–99*g* are arranged and configured so as to be located above the corresponding sheet 50*a*–50*g* and rod 51*a*–51*g* when cover 103 is closed. This provides further insurance that the sheets 50*a*–50*g*, even if not placed in the slots 107 properly, will remain in dispenser 100 when the ties 52 are pulled from the sheets 50 (i.e., if a user pulls a tie 52 upward in order to remove the tie 52 from the sheet 50, the rod 51 will contact pin 99 and the contact will tend to keep the rod 51 within the slot 107). Latching pins 95 are provided to engage with slots 107 and are sized to "snap" into the slots 107 thereby providing a positive lock for cover 103.

Side locks 98 comprise a member which extends approximately normal to back 101. The member includes a pawl member 97 which extends through a hole 96 formed in side 102. Therefore, as in the preferred dispenser 100, the sides 102 may be constructed integrally to rear 101 with a living hinge constructed therebetween. The sides 102 may then be locked into position utilizing side locks 98.

Figure 3:
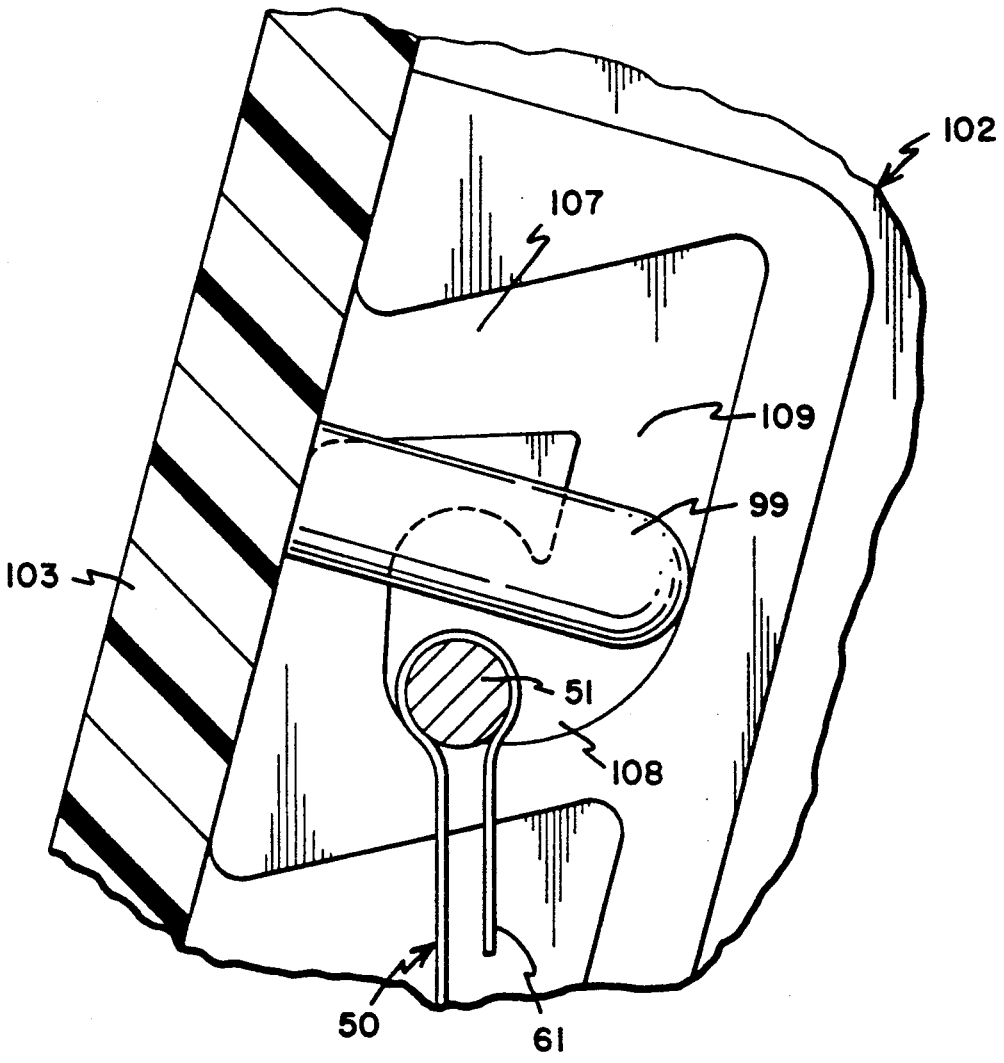
FIG. 3 is an enlarged side elevation view of a portion of a slot 107 of FIG. 1.
Figure 9:
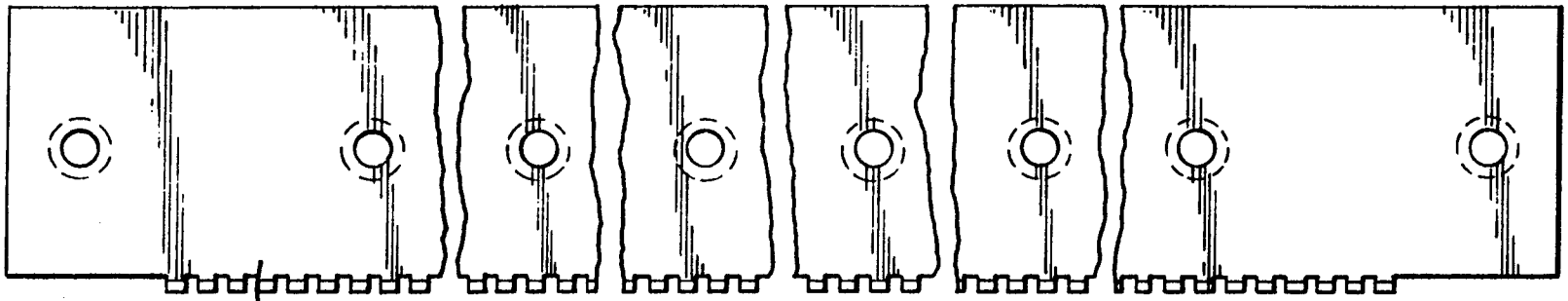
FIG. 9 is a plan view of perforation blade 250 of second cutting area 245 of FIG. 5.

Referring to FIGS. 1, 2 and 3, slots 107 are defined in side edges 102. Each slot 107 corresponds to an area in which to hang a sheet 50. In the preferred embodiment, there are seven slots 107*a*–107*g*, providing for seven sheets 50*a*–50*g* of twist-tie material to be inserted into dispenser 100, although other numbers of slots might be used as will be appreciated by those skilled in the art. Those skilled in the art will appreciate that for the purpose of maintaining a supply of ites 52 in a grocery setting, a large number of sheets 50 is desirable. The number, however, must be practically limited due to size considerations of the dispenser 100.

Slots 107 preferably do not extend through the exterior face of sides 102. The exterior faces being defined as those faces which are not opposing one another. Instead, slots 107 are formed to extend through only a portion of the width of sides 102 (i.e., the slot is defined in the interior, or opposing faces, of sides 102). Those skilled in the art will recognize that the slots 107 might also be formed by extending a portion of the slot walls so as to form a slot on the interior face of sides 102.

The slots 107 are arranged and configured such that rods 51 may be slidably inserted into slots 107 simultaneously in both side portions 102*a*, 102*b*. Slots 107 are further arranged and configured so that rods 51 reside in end portion 108 when the rods 51 are fully inserted into slot 107. The J-shape of slots 107 resulting in end portion 108 and middle portion 109 provides advantages discussed further below in connection with the operation of dispenser system 20.

Referring next to FIG. 4, there is illustrated an enlarged portion of a single sheet 50 of cut individually removable twist-tie material. Individual ties 52 on the same sheet 50 are arranged/cut to a single length (in an alternative embodiment, the length varies with alternating twist-ties 52—not shown). Ties 52 also include two transverse cuts 53, 54 and longitudinal cuts 65. These cuts will be described further below in connection with the fabrication of the twist-tie sheets 50. The individual ties 52 are arranged in a side-by-side manner, and are cut longitudinally from first end 62 up to proximate the transverse perforation 53. Preferably, the longitudinal cut 65 extends up to transverse cut 53 so as to provide for easy separation of individual twist-ties 52 from the integral portion 56. The integral portion 56 may be defined as that area of the twist-tie sheet 50 extending from the area of the transverse cuts 53, 54 to second end 61. However, the longitudinal cut 65 may extend slightly into the integral portion 56 or proximate to the integral portion 56. Individual ties 52 are therefore integral with one another at second end 61.

In the preferred embodiment, paper-covered, wire-type twist-ties are utilized for sheets 50. Such tie materials are commonly manufactured by Bedford Industries of Worthington, Minn., designated as uncut ganged ties. In such uncut ganged ties, a wire 55 is embedded into two layers of paper between which is bonded the wires 55. Typically, rolls of this material are at least 1,000 feet in length with a width of approximately 61 ties (i.e., 61 wires with paper therebetween and a ½ width on either side edge). Each individual tie 52 is preferably 5/32 inch transverse width. Since there are preferably 61 ties, the uncut material is therefore approximately 9½ inches wide and approximately 5 inches long. The ties 52 are approximately 4 inches long, with approximately 1 inch of material (comprising the integral portion) remaining about the rod 51. Of course other widths and lengths may be easily accommodated and are a matter of design choice.

The series of perforations 53, 54 are made transversely to the longitudinal axis of individual tie 52 to facilitate the removal of individual ties 52 from the sheet 50. The first transverse perforation 54 is performed across the wire 55 of twist-tie 52. Preferably, the perforation 54 does not extend transversely across the entire tie 52. Instead, the perforation 54 is located in the approximate transverse center of tie 52. The second transverse perforation 53 is preferably located in the transverse center between the wires 55 and a predetermined longitudinal distance from the first perforation 54. The second perforation 53 performs two functions. The first function is to cut the wire 55 in the event that either the wire 55 "wanders" slightly in the bulk material or if the cutting devices (described below) are off reference during the fabrication process. The second function is to provide for easier tearing of the material. In this manner, the paper (or other material) of the twist-tie 52 keeps the individual twist-tie 52 attached to the integral portion/second end 61. Preferably the cutting edge which makes the perforation 54 is sized and configured so as to be smaller than the width of individual twist-tie 52. In this manner, even if the twist-tie material moves "off reference" during the manufacturing process, the entire width of the twist-tie 52 is not severed (i.e., the twist-tie 52 remains connected to integral portion 56).

Those skilled in the art will recognize that since a plurality of ties 52 are located on each sheet 50, a series of perforations are performed, not a single perforation. Such series of perforations may occur, however, in one or more steps. For clarity herein, a single tie 52 and its perforations 53, 54 are described.

Second perforations 53 may be considered optional. However, as noted above, by performing the additional transverse perforations, ease of removal of an individual tie 52 may be increased, while further ensuring that if referencing of the cutting means is not correctly adjusted, wire 55 will still be perforated, thereby ensuring easy removal of tie 52.

Fabrication

Figure 5:
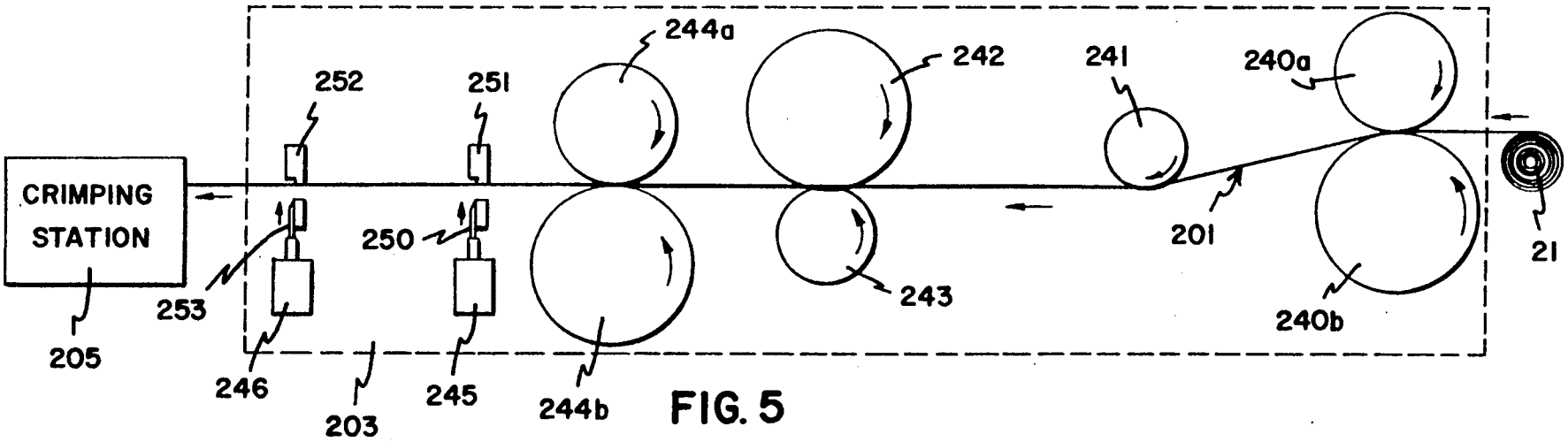
FIG. 5 is a schematic diagram illustrating the various process steps in a preferred method for fabricating sheet 50 of FIG. 1.

Referring next to FIG. 5, a preferred method of fabricating a sheet 50 of ties 52 will be described. The process comprises a series of steps which takes a stock 21 of uncut twist-tie material 201 (i.e., rolls of uncut paper with wires 55 running through them), appropriately cuts and perforates the material 201 to form sheets 50. The sheets 50 are then cooperatively connected to a rod 51.

First, the uncut web material 201 is advanced to the first cutting area of the cutting station 203 through a first set of counter-rotating rollers 240*a*, 240*b*. Material 201 then proceeds beneath tracking roller 241, and between the counter-rotating male cutting roller 242 and female roller 243 which together comprise a set of "rotating knives." The rotating knives tend to skew the material to one side, thereby necessitating the tracking roller 241. The operation of the first cutting area of the cutting station will be deferred pending completion of the description of various elements of FIG. 5.

Before exiting the first cutting area, the material 201 advances between a second set of counter-rotating rollers 244*a*, 244*b*. The second set of rollers 244 have a slightly larger diameter than first set of rollers 240. Therefore, when the shaft speed of the two sets of rollers 244, 240 is equal, the circumference of rollers 244 turns at a higher speed, therefore tensioning the material 201 between the two sets of rollers 240, 244. Preferably, rollers 240, 244 are constructed of a slotted metal such as steel, wherein the slots are sized and configured to coincide with the wires 55 in the material 201.

After exiting the second set of rollers 244*a*, 244*b*, the material 201 advances to second cutting area 245 of the cutting station 203 to perforate the wire 55 and twist-tie 52 transversely (i.e., form perforations 53 and 54). Second cutting area 245 is comprised of two perforating knives 250 and cutting surfaces 251. The second cutting area 245 provides the transverse cuts across the wire 55 and material between the wires 55 of the twist-ties 52. Second cutting area 245 is preferably comprised of two guillotine-style knives. Material 201 then advances to the third cutting area 246 which includes a cutting blade 253 and cutting surface 252. The cutting blade 253 cuts the entire transverse width of the material 201, thereby simultaneously forming the first end 62 of the sheet 50 and the second end 61 of the next sheet 50 immediately behind the first sheet 50. Cutting blade 253 is also preferably a guillotine-style blade.

Prior to performing the cutting step of the third cutting area 246, the second end 61 is crimped about rod 51 (discussed below). This in essence holds the material 201 in place during the crimping step. The final cut is performed subsequent to the crimping step.

Referring next to FIG. 6, is illustrated a preferred perforation knife 250 for cutting twist-tie material 201 transversely through the wire 55 of the individual twist-ties 52 and to transversely cut between the wires. Those skilled in the art will recognize that two knives having the pattern of knife 250 are utilized with the cutting surfaces offset from one another. Cut-off knife 253 is similar to knife 250 with the exception that there are no gaps between the cutting edges. The twist-tie material 201 is advanced incrementally by counter-rotating rollers 240 and 244 with the male cutting roller 242 providing the continuous longitudinal cut 65, alternating with perforations over the integral portion 56.

The second cutting area 245 is driven by a programmable logic controller 270 (best seen in FIG. 10) to actuate at proper intervals as the twist-tie material 201 is incrementally advanced. Additionally, cut-off knife 253 is controlled by controller 270 to actuate at proper intervals. In this manner, sheets 50 are properly cut longitudinally and transversely.

Figure 7:
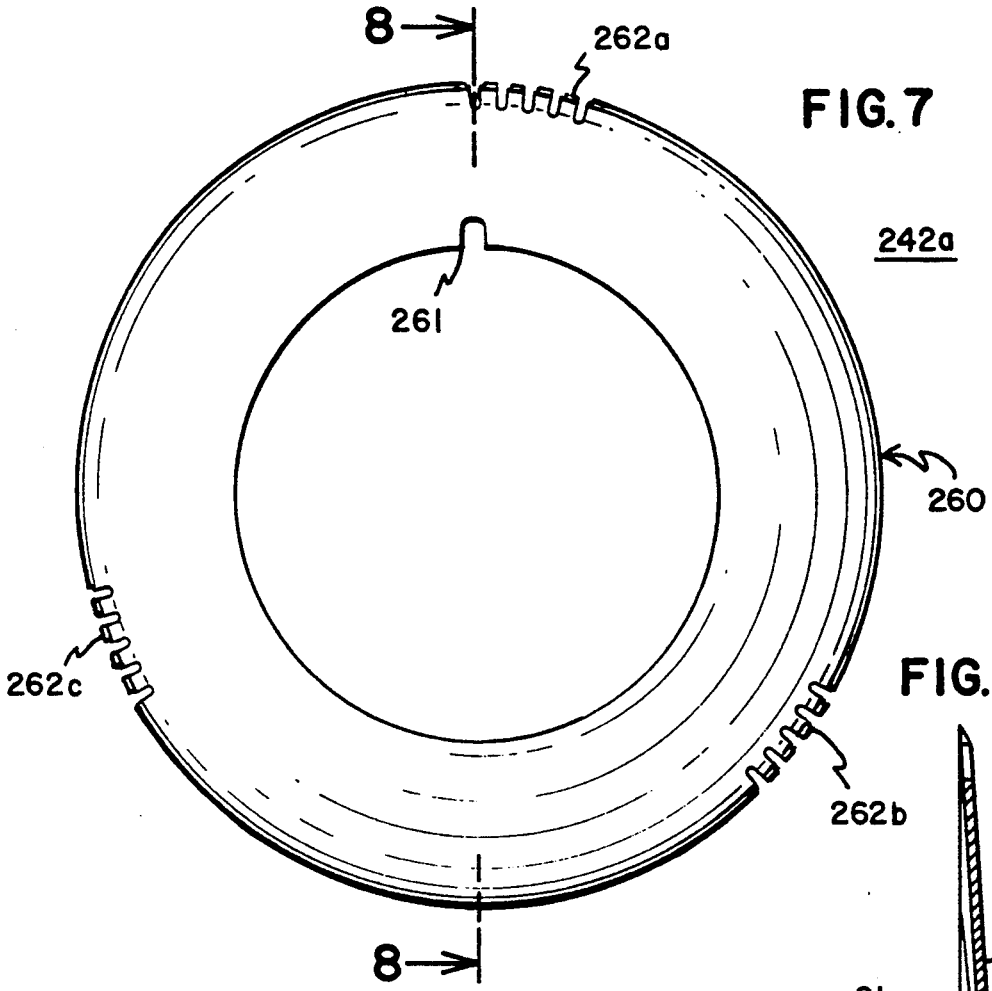
FIG. 7 is a plan view of an individual male cutting disk 242*a* of cutting dis 242 of FIG. 6.
Figure 8:
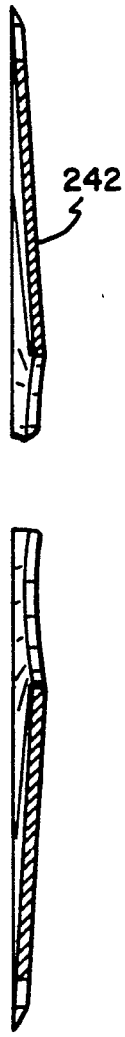
FIG. 8 is a cross-sectional view of male cutting disk 242*a* taken through line 8—8 of FIG. 7, with portions broken away.

Next, reference should be had to FIGS. 6, 7, and 8 wherein the operation of male cutting roller 242 will become more apparent to those skilled in the art. Referring first to FIG. 6, male cutting disk 242*a* is illustrated. The male cutting roller 242 is comprised of a plurality of disks 242*a*, 242*b*, etc. (best seen in FIG. 6). As those skilled in the art will recognize, for each longitudinal cut 65 of the twist-tie material 201, a separate male cutting disk 242 and corresponding female disk 243 is required. The longitudinal cut 65 is achieved by biasing the cutting edge 260 against a female cutting surface 265 (best seen in FIG. 6) in a well known manner. Those skilled in the art will recognize such a cutting arrangement (commonly referred to as a "rotating knife" cutting system).

The male cutting disk 242*a* includes a notch 261 which corresponds to a keyway in the center of the male cutting roller 270 which secures the male cutting disk 242*a* in place about the roller 270. Additionally, perforation sections 262*a*, 262*b*, and 262*c*, are provided at intervals about the periphery of male cutting disk 242*a*. Perforated sections 262 are provided so as to merely perforate and not completely longitudinally cut the twist-ties 52 apart from one another at predetermined intervals. The portions between the point where the longitudinal cut 65 ends and second end 61 (i.e., the integral portion 56) corresponds to that section of material 201 where the perforated sections 262 pass over the material 201. Those skilled in the art will recognize that depending on the height of the teeth of the perforated sections 262, the integral portion 56 may actually be perforated through the material 201, or the material 201 may not have been perforated.

The perforation sections 262 are required to maintain the cutting disks 242 reference on the twist-tie material 201 (i.e., due to the uncut width/integral portion required for the uncut/second end of the material to be wrapped about rod 51, the referencing of the male disks 242 can not be maintained without keeping contact with the material 201; additionally, the perforated sections 262 keep the male 242 and female 243 knife sections in proper contact with one another). Those skilled in the art will recognize that the size of the perforation sections 262 about the circumference of cutting edge 260 is dependent upon the amount of material 201 to be wrapped about the rod 51, and the tension on the twist-tie material 201 provided by roller 241 among other factors.

Referring next to FIG. 8, those skilled in the art will recognize that the male cutting disks 242 and other cutting disks are cupped such that they may be biased against female cutting disk 243 to provide clean cuts through the twist-tie material 201.

Returning to FIG. 5, crimping station 205 wraps second end 61 of the sheet 50 about a rigid rod 51. A more detailed discussion of crimping station 205 is set forth below.

Figure 10:
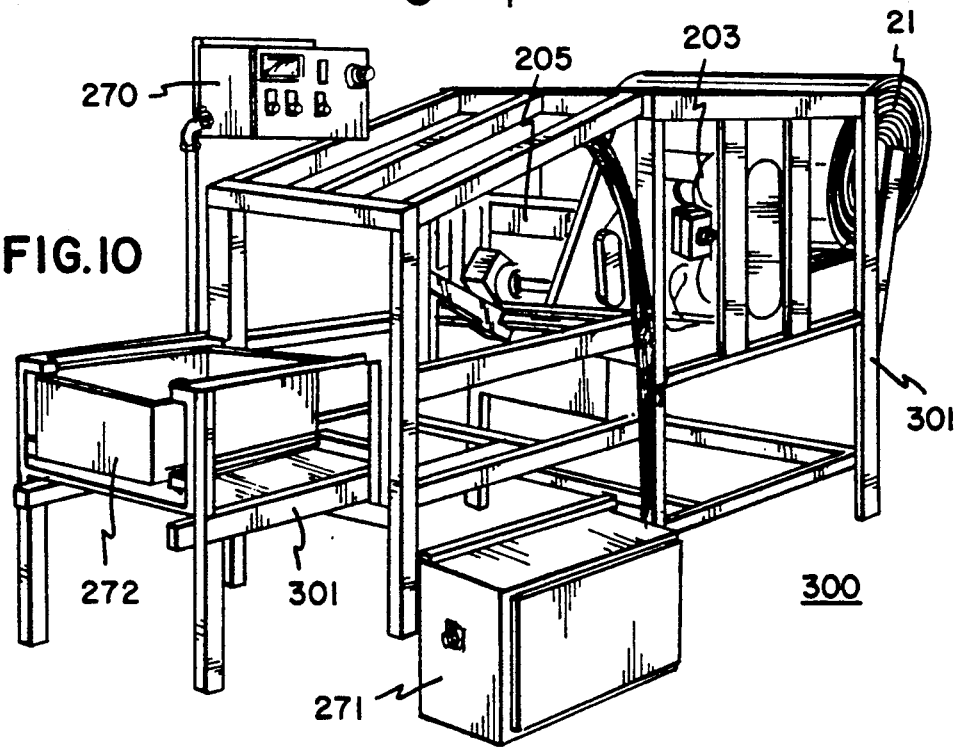
FIG. 10 is a perspective view of a manufacturing apparatus 300 constructed according to the principles of the present invention.
Figure 11:
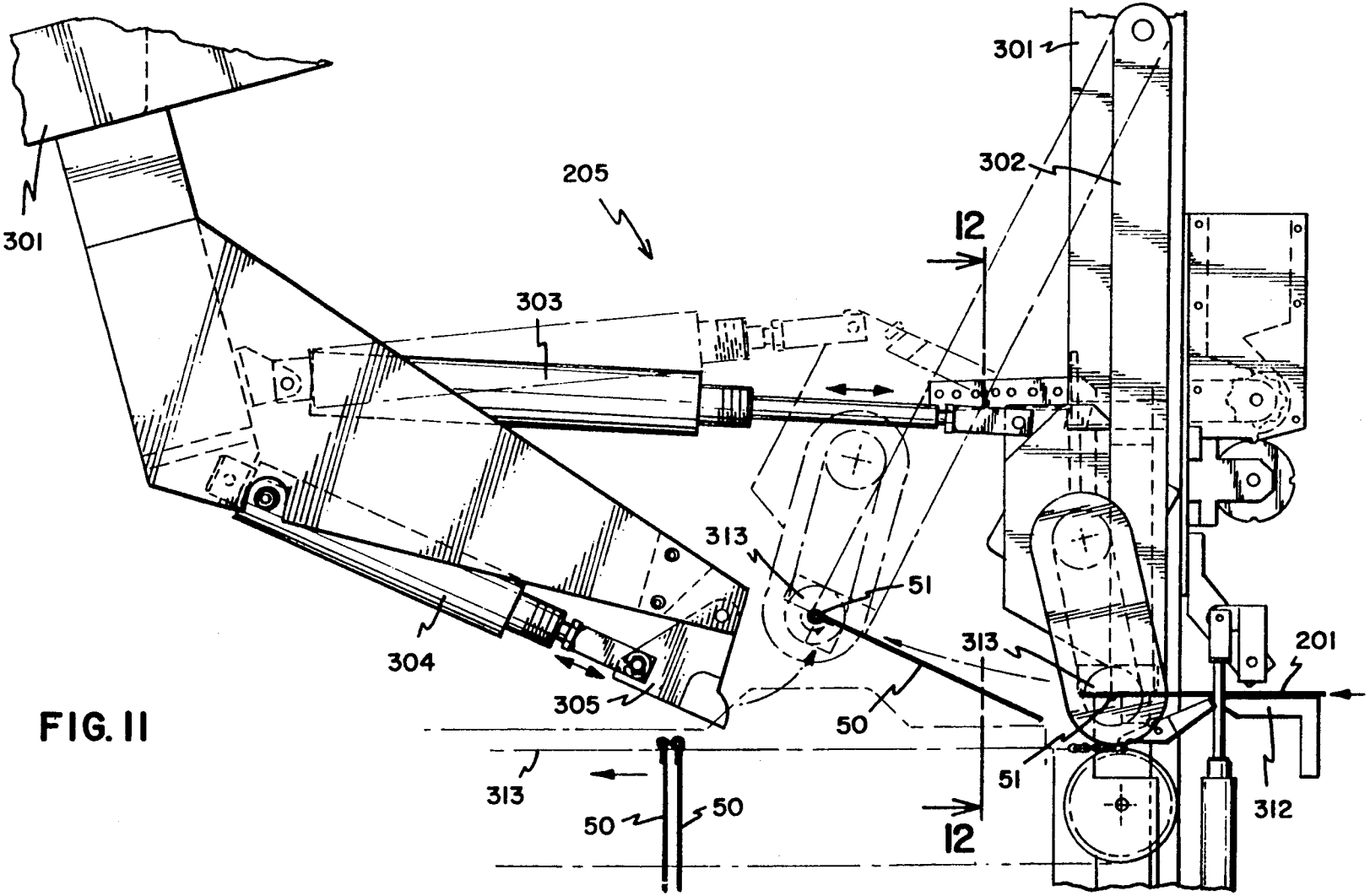
FIG. 11 is a side elevation of crimping station 205 of FIG. 5.
Figure 12:
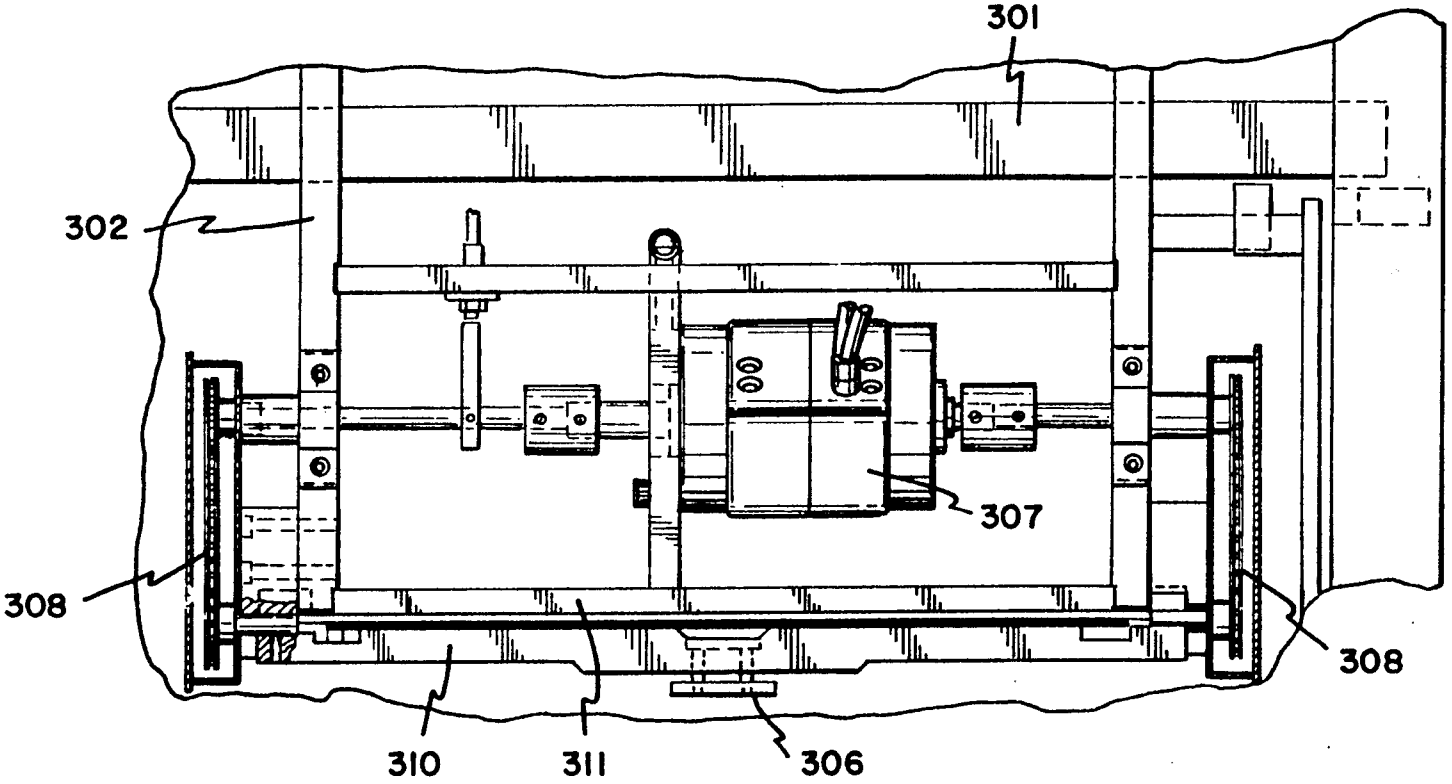
FIG. 12 is a cross-sectional view of crimping station 205 taken through line 12—12 of FIG. 11.
Figure 13A:
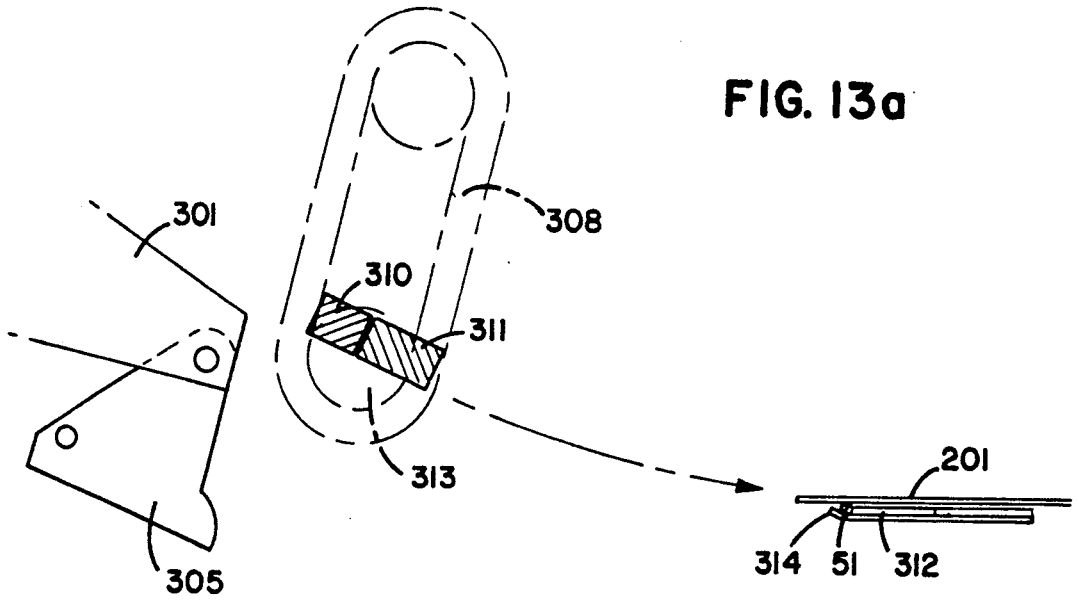
Figure 13B:
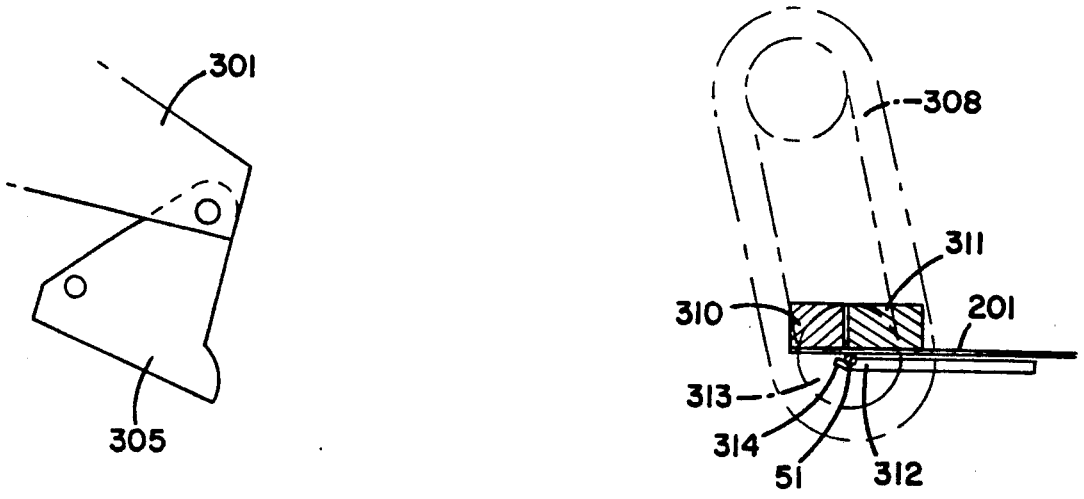

Referring next to FIG. 10, there is illustrated a preferred embodiment apparatus 300 which includes the various elements schematically illustrated in FIG. 5. In such embodiment 300, a programmable logic controller 270 such as the model designated as the C-LOK-COR-A manufactured by Omron of Japan, is utilized. Those skilled in the art, however, will understand that any such processor having programming capability and proper interface for use in a manufacturing setting might be utilized. The controller 270 controls the timing and actuation of the various components described herein. Those skilled in the art will immediately appreciate operation of controller 270 and so controller 270 will not be discussed further. Power supply center 271 provides power to the various motors and actuators in the preferred embodiment. Operation of power supplies are also well understood by those skilled in the art and so will not be further described herein.

Apparatus 300 provides a frame system 301 for delivering the supply of stock uncut ganged twist-tie material 21 through the various components of the cutting station 203, and into crimping station 205, and finally stacked into boxes 272 for shipment.

Referring next to FIGS. 11, 12 and 13*a*–13*d*, there is illustrated a preferred apparatus for folding/crimping twist-tie material 201 about rod 51. The crimping station 205 includes a bail arm 302 which is pivotally attached to frame 301. Attached to bail arm 302 is cylinder 303 which, when extended/retracted, moves the bail arm 302 between an inclined first position to a vertical second position (in FIG. 11 the first position is shown in phantom).

When the bail arm 302 is in its first operative position the twist-tie material 201 is moved over rod 51 and bed member 312. The hinged plate 310, 311 is then swung over the twist-tie material 201 by moving bail arm 302 to its second position. The hinged plate 310, 311 crimps or folds the material 201 about rod 51. Third cutting area 246 of cutting station 203 then actuates. Cylinder 303 then retracts, drawing the twist-tie material 201 which has now been transformed into a sheet 50) and the rod 51 into the first operative position. Cylinder 304 expands driving center member 305 onto the spring-loaded member 306 to finalize the crimping process. The hinged plate 310, 311 is then activated to straighten (by motor 307 via drive chains 308 controlled by controller 270) and the completed crimped twist-tie sheet 50 are then dropped onto a conveyor 313 to be placed in boxes 272.

The hinged plate 310, 311 preferably includes a first half which does not move, while the second half rotates. In the preferred embodiment plate 311 is fixed to bail arm 302, while plate 310 rotates about axis 313. Since the axis is composed of a rotatable cylindrical piece, plate 310 can be sized and configured to rotate about rod 51 such that when the crimp has been completed (best seen in FIG. 13*d*), the rod 51 is not located between plates 310 and 311; thereby insuring a crimp which is snug about a larger portion of the circumference of rod 51.

Spring loaded member 306 is provided in order to crimp the middle of the integral portion 56 of sheet 50 to rod 51. This portion is not crimped by plates 310 and 311, since the plates 310, 311 are configured with a portion cut out (not shown). The cut out is necessitated in order to crimp about finger 314 which holds rod 51 as material 201 is advanced. Three fingers 314 are provided with one on each end and one in the middle.

FIGS. 12*a* through 12*e* illustrate the sequential positions of the bail arm 302, hinged plate 310, 311, pistons 303, 304 and other members which comprise the folding means of the crimping station 205.

Preferably, the rod 51 is longer than the sheet 50 is wide. This allows for insertion of the rod 51 into slots 107. Those skilled in the art will recognize that other sheet hanging means might be utilized in lieu of rod 51, such as cardboard and plastic among others. Additionally, the sheets 50 may be utilized without a rod 51.

In the preferred embodiment, sheets 50 have a count of 61 individual ties 52 which are cut along the sides and bottom. As noted above, alternating ties 52 may be cut slightly shorter than the others to allow for easy discrimination and removal by consumers. Only the wire 55 portion of the tie 52 is completely cut, with the second perforation 53 removing only a portion of the paper and the longitudinal cut 65 may be a perforation through the material 201 or a complete cut. The remaining paper or plastic portion holds the tie 52 to the sheet 50 until the consumer applies a force to the first end 62, thereby ripping the remaining paper/plastic and releasing the tie 52 from sheet 50. The top integral portion 56 of the tie 52 (i.e., that material above the second perforation 53) remains intact about rod 51 upon removal of the tie 52. The top portion 56 that remains about rod 51 may be discarded after removal of the ties 52.

An alternative method of fabrication is set forth in issued U.S. Pat. No. 4,948,202, which is commonly assigned to the same assignee of this application, which is hereby incorporated by reference.

Those skilled in the art will also recognize that other die cutting methods such as hard tool dies may also be utilized in cutting station 203, among others. Additionally, those skilled in the art will recognize that no effort has been made to correlate each and every individual twist-tie 52, or first and second perforations 53, 54, or first and second ends 61, 62 of ties 52 illustrated in the accompanying Figures.

Operation

In operation, best seen in FIGS. 1 and 3, the fabricated sheets 50 are placed with rod 51 into slots 107 in dispenser 100. The number of sheets 50 inserted into dispenser 100 being a matter of design choice. Hinged cover 103 is then closed thereby readying dispenser system 20 for removal of ties 52 from sheets 50. Due to the resiliency of rod 51, removal of ties 52 may tend to cause a rebound of the rod 51. The rebound is reduced by the shape of slot 107 and rod 51 residing in end portion 108 being J-shape and the closing of cover 103 during operation. These precautions ensure that the sheets 50 do not spring out of the dispenser 100. Those skilled in the art will recognize that rods 51 might also be made of a less resilient material (rod 51 is preferably metal with a diameter of approximately 3/32 and a length of 10.5 inches in the preferred embodiment) to avoid rebounding. As the ties 52 are removed from sheet 50, the ties 52 in the sheet 50*b* behind the depleted first sheet 50*a* become visible, thereby ensuring an adequate supply of individual ties 52 for selection by a consumer without complex manipulation, requiring two hands to remove a tie 52, or requiring a container containing a plurality of loose individual ties 52.

Middle portion 109 of slot 107 is provided to further urge rod 51 to remain in slot 107 during dispensing. Middle portion 109 helps reduce the rebound problem described above when a tie 52 is removed with a downward force thereby biasing the rod 51, since middle portion 109 is offset from the bottom portion 108 where the rod 51 tends to rest. Middle portion 109 also ensures that if a consumer applies a force directed toward the front or top of the dispenser 100, the rod's 51 upward movement is limited by middle portion 109 being located in a rearward direction from the force applied to the tie 52 by the consumer.

The series of perforations 53, 54 provide for easier removal of ties 52 by requiring less material to be ripped. Further, the perforations 53, 54 allow a slight reference problem and still cut wire 55 (i.e., second perforations 53 are preferably arranged and configured to cut the wire, 55 if first perforations 54 do not).

It will be appreciated that the principles of this invention apply not only to the twist-tie material described to implement the invention, but also to the method and apparatus in general of implementing a covered twist-ties style dispensing device. While a particular embodiment of the invention has been described with respect to its application for dispensing twist-tie material in grocery or foodstuffs environment, it will be understood by those skilled in the art that the invention is not limited to such application or embodiment or to the particular dispenser device described herein. It will be appreciated by those skilled in the art that other twist-tie style devices and dispensers that embody the principles of this invention and other applications therefor other than as described herein can be configured within the spirit and intent of this invention. The dispenser and cut sheet format of the twist-tie material described herein is provided only as an example of one embodiment that incorporates and practices the principles of this invention. Other modifications and alterations are well within the knowledge of those skilled in the art and are to be included within the broad scope of the appended claims.

What is claimed is:

1. A method of fabricating a sheet of twist-tie material for dispensing in a dispenser, of the type wherein individual twist-ties may be removed, the method comprising the steps of:

(a) advancing a strip of uncut twist-tie material into a cutting station, said strip having wires aligned generally parallel to the longitudinal axis of the strip;

(b) perforating said wires of said twist-tie material at a predetermined distance from a leading edge in said cutting station;

(c) perforating said twist-tie material longitudinally using rotating knives so as to form longitudinal cuts between said wires forming individually releasable twist-ties, while intermittently leaving a predetermined distance undisturbed, wherein adjacent twist ties are integrally connected with one another in said intermittently undisturbed areas;

(d) completely cutting said twist-tie material transversely across said material at a predetermined distance from said leading edge; and (e) advancing said strip of twist-tie material and repeating steps (a) through (d), wherein said complete transverse cutting step at a predetermined distance from said leading edge creates a new leading edge of the advanced twist-tie material and forms a cut sheet.

2. The method of claim 1, further comprising the step of crimping the undisturbed portion of said cut sheet of twist-tie material about a rod.

3. The method of claim 1, wherein said longitudinal perforation step completely cuts said twist-tie material.

4. The method of claim 1, wherein step (b) further comprises perforating said twist-tie material at a second predetermined distance from the leading edge in said cutting station, wherein individual twist-ties are easier to remove and referencing of the cutting apparatus is minimized.

5. The method of claim 1, wherein said complete transverse cut is a straight transverse cut using guillotine blades.

6. A method of manufacturing a sheet of twist-tie material, comprising the steps of:

(a) drawing a web of uncut, ganged twist-tie material having wires running generally parallel to one another and to the longitudinal axis of said material, between a rotating knife wherein said rotating knife completely cuts a predetermined length of twist tie material and intermittently does not cut a second predetermined length, said cut portions lying between said wires;

(b) perforating the wire generally proximate the space where the cut and uncut areas of twist tie material meet, wherein said perforation step leaves enough twist tie material transversely between cuts such that the cut tie remains affixed to the uncut area; and (c) cutting the twist tie material transversely to from an individual sheet.

7. The method of claim 6, wherein steps (a)–(c) are repeated and wherein step (c) forms the first end of a first sheet of twist-tie material while simultaneously forming the second end of a second sheet of twist-tie material.

8. The method of claim 7, wherein said drawing step includes securing the material between two sets of counter-rotating rollers, wherein one set is on either side of said rotating knife.

9. The method of claim 8, wherein said drawing step includes guiding said material through said rotating knives with a slotted roller, wherein said slots of said slotted roller are arranged and configured to correspond to the wires of said material, whereby the material is guided by said slotted roller.

10. The method of claim 7 further including folding said material about a rod.

11. The method of claim 7, further including affixing several sheets to one another at the uncut area with an adhesive.

12. The method of claim 6, further including folding said material about a rod.

13. A method of manufacturing a sheet of twist-tie material, comprising the steps of:

(a) drawing a web of uncut, ganged twist-tie material having wires running generally parallel to one another and to the longitudinal axis of said material, between a rotating knife wherein said rotating knife completely cuts a predetermined length of twist tie material and intermittently does not cut a second predetermined length, said cut portions lying between said wires, and wherein said drawing step includes securing the material between two sets of counter-rotating rollers, wherein one set is on either side of said rotating knife;

(b) perforating the wire generally proximate the space where the cut and uncut areas of twist tie material meet, wherein said perforation step leaves enough twist tie material transversely between cuts such that the cut tie remains affixed to the uncut area, and wherein said perforating step includes severing said wires with a guillotine blade; and (c) cutting the twist tie material transversely to form an individual sheet;

wherein steps (a)–(c) are repeated and wherein step (c) forms the first end of a first sheet of twist-tie material while simultaneously forming the second end of a second sheet of twist-tie material.

14. The method of claim 13, wherein said cutting step includes severing the material with a guillotine blade.

15. A method of manufacturing a sheet of twist-tie material, comprising the steps of:

(a) drawing a web of uncut, ganged twist-tie material having wires running generally parallel to one another and to the longitudinal axis of said material, between a rotating knife wherein said rotating knife completely cuts a predetermined length of twist tie material and intermittently does not cut a second predetermined length, said cut portions lying between said wires;

(b) perforating the wire generally proximate the space where the cut and uncut areas of twist tie material meet, wherein said perforation step leaves enough twist tie material transversely between cuts such that the cut tie remains affixed to the uncut area;

(c) cutting the twist tie material transversely to form an individual sheet; and (d) folding said material about a rod, wherein said folding step includes:

(i) positioning a rod below a hinged plate;

(ii) placing said material between said rod and said hinged plate; and (iii) rotating said hinged plate about said hinge, wherein said material is crimped by said rotating plate about said rod;

wherein steps (a)–(c) are repeated and wherein step (c) forms the first end of a first sheet of twist-tie material while simultaneously forming the second end of a second sheet of twist-tie material.

16. A method for fabricating a sheet of twist-tie material, of the type wherein individual twist-ties may be removed, comprising the steps of:

(a) advancing a strip of uncut twist-tie material into a cutting station, said strip having a first end and a second end;

(b) longitudinally cutting said twist-tie material from said first end to a predetermined distance, said longitudinal cut forming two or more longitudinal strips which are integrally connected to none another at said second end, wherein said predetermined distance is less than the final length of the sheet;

(c) perforating said twist-tie material transversely at a predetermined distance from said second end, wherein said longitudinal strips remain integral with said uncut second end;

(d) cutting the material at the first end, advancing the material, and repeating steps (a) through (c), wherein said cutting step at said first end creates a second end of the advancing twist-tie material.

17. The method of claim 16, further comprising the step of crimping said second end about a rod.

18. An apparatus for fabricating a sheet of twist-tie material, of the type wherein individual twist-ties may be removed, comprising:

(a) means for advancing a strip of uncut twist-tie material into a cutting station, said strip having a first end and a second end;

(b) means for longitudinally cutting said twist-tie material from said first end to a predetermined distance, said longitudinal cut forming two or more longitudinal strips which are integrally connected to one another at said second end, wherein said predetermined distance is less than the final length of the sheet;

(c) means for perforating said twist-tie material transversely at a predetermined distance from said second end, wherein said longitudinal strips remain integral with said uncut second end; and (d) means for cutting the material at the first end, wherein said means for perforating at said first end creates a second end of the advancing twist-tie material.

19. The apparatus of claim 18, further comprising means for crimping the material about a rod, said crimping means including:

(a) means for positioning a rod below a hinged plate;

(b) means for placing the material between said rod and said hinged plate; and (c) means for rotating said hinged plate about said hinge, wherein said material is crimped by said rotating plate about said rod.

* * * * *

UNITED STATES PATENT AND TRADEMARK OFFICE

CERTIFICATE OF CORRECTION

PATENT NO. : 5,232,431

DATED : August 3 1993

INVENTOR(S) : James R. Helseth

It is certified that error appears in the above-identified patent and that said Letters Patent is hereby corrected as shown below:

In the Abstract, line 17, for "20" read --201--.
In column 1, line 5, for "continuation-part" read --continuation-in-part--.
In column 4, line 28, for "sires" read --wires--.
In column 5, line 22, for "dis" read --disk--.
In column 7, line 49, for "ites" read --ties--.
In column 9, lines 43, 44, for "Preferrably" read --Preferably--.
In column 14, line 37, for "from" read --form--.
In column 16, line 10, for "none" read --one--.

Signed and Sealed this

Twenty-second Day of March, 1994

*Attest:*

Bruce Lehman

BRUCE LEHMAN

*Attesting Officer*

*Commissioner of Patents and Trademarks*